US009816681B1

(12) United States Patent
Householder

(10) Patent No.: US 9,816,681 B1
(45) Date of Patent: Nov. 14, 2017

(54) SIDE LIT INDIRECT FLEXIBLE LIGHTING SYSTEM

(71) Applicant: Universal Lighting Technologies, Inc., Madison, AL (US)

(72) Inventor: John R. Householder, Cedar Park, TX (US)

(73) Assignee: Universal Lighting Technologies, Inc., Madison, AL (US)

( * ) Notice: Subject to any disclaimer, the term of this patent is extended or adjusted under 35 U.S.C. 154(b) by 15 days.

(21) Appl. No.: 15/145,211

(22) Filed: May 3, 2016

Related U.S. Application Data

(60) Provisional application No. 62/157,768, filed on May 6, 2015.

(51) Int. Cl.

| | |
|---|---|
| ***F21S 4/00*** | (2016.01) |
| ***F21V 7/00*** | (2006.01) |
| ***F21V 21/14*** | (2006.01) |
| ***F21V 5/04*** | (2006.01) |
| ***F21V 13/04*** | (2006.01) |
| ***F21V 7/18*** | (2006.01) |
| *F21Y 101/02* | (2006.01) |
| *F21Y 103/00* | (2016.01) |
| *F21V 7/05* | (2006.01) |

(52) U.S. Cl.
CPC ..... *F21V 7/0008* (2013.01); *F21V 5/045* (2013.01); *F21V 7/0075* (2013.01); *F21V 7/18* (2013.01); *F21V 13/045* (2013.01); *F21V 21/145* (2013.01); *F21V 7/05* (2013.01); *F21Y 2101/02* (2013.01); *F21Y 2103/003* (2013.01)

(58) Field of Classification Search
CPC ..... F21V 7/0008; F21V 7/0075; F21V 7/05; F21V 7/18; F21V 21/145
See application file for complete search history.

(56) References Cited

U.S. PATENT DOCUMENTS 5,584,566 A * 12/1996 Bowman ..... F21S 2/00 362/220
6,257,737 B1 7/2001 Marshall et al.
6,390,638 B1 * 5/2002 Miller ..... G02B 6/0055 362/23.13
7,574,822 B1 8/2009 Moore
(Continued)

FOREIGN PATENT DOCUMENTS

NL WO 2015154825 A1 * 10/2015 ..... F21K 9/90

*Primary Examiner* — Alexander Garlen
(74) *Attorney, Agent, or Firm* — Patterson Intellectual Property Law, P.C.; Mark J. Patterson; Gary L. Montle

(57) ABSTRACT

A portable indirect lighting apparatus includes first and second support structures. Each support structure includes a respective longitudinal light source having a linear array of light-emitting diodes (LEDs). A respective longitudinal lens is positioned proximate to each linear array of LEDs to receive and redirect the light emitted by the LEDs. A flexible reflector extends between the first and second support structure. The reflector has at least one diffusedly reflective surface. The reflector is configurable to an operational configuration with the diffusedly reflective surface positioned to receive the light redirected by the first and second longitudinal lenses. The reflector is configurable to a transportable configuration with at least a portion of the reflector wrapped around at least one of the first and second support structures.

2 Claims, 4 Drawing Sheets

(56) References Cited

U.S. PATENT DOCUMENTS

| | | | | |
|---|---|---|---|---|
| 7,837,370 | B2 | 11/2010 | Bierhuizen et al. | |
| 2005/0136200 | A1* | 6/2005 | Durell | B32B 27/08 428/35.7 |
| 2009/0316383 | A1* | 12/2009 | Son | F21V 9/10 362/84 |
| 2011/0199765 | A1* | 8/2011 | Simons | F21V 7/0008 362/235 |
| 2012/0287674 | A1* | 11/2012 | Nichol | G02B 6/0018 362/611 |
| 2013/0294053 | A1* | 11/2013 | Marquardt | F21V 33/006 362/145 |
| 2014/0268715 | A1* | 9/2014 | Boyer | F21V 7/0008 362/217.05 |

* cited by examiner

SIDE LIT INDIRECT FLEXIBLE LIGHTING SYSTEM

CROSS-REFERENCES TO RELATED APPLICATIONS

This application claims benefit of the following patent application which is hereby incorporated by reference: U.S. Provisional Patent App. No. 62/157,768 filed May 6, 2015, entitled "Side Lit Indirect Flexible Lighting System."

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

Indirect lighting systems are well known; however, conventional indirect lighting systems are bulky and are not readily transportable for use as temporary lighting. For example, temporary lighting is often needed at a job site; however, conventional temporary lighting is typically direct lighting, which causes glare.

BRIEF SUMMARY OF THE INVENTION

A need exists for a temporary lighting system that provides indirect lighting and that has a small form factor so that the indirect lighting system can be easily transported to a job site. The lighting system disclosed herein provides an indirect lighting system using light-emitting diodes (LEDs) to side light a diffuser comprising a flexible material. The flexible diffuser sheet can be rolled up around the LEDs for transportation to and from a job site.

One aspect of the invention in accordance with the embodiments disclosed herein is portable indirect lighting apparatus. The lighting apparatus includes first and second support structures. Each support structure includes a respective longitudinal light source having a linear array of LEDs. A respective longitudinal lens is positioned proximate to each linear array of LEDs to receive and redirect the light emitted by the LEDs. A flexible reflector extends between the first and second support structure. The reflector has at least one diffusedly reflective surface. The reflector is configurable to an operational configuration with the diffusedly reflective surface positioned to receive the light redirected by the first and second longitudinal lenses. The reflector is configurable to a transportable configuration with at least a portion of the reflector wrapped around at least one of the first and second support structures.

Another aspect of the invention in accordance with embodiments disclosed herein is a portable indirect lighting apparatus. The lighting apparatus comprises a first support structure and a second support structure. The first support structure comprises a first longitudinal light source. The first longitudinal light source comprises a first linear array of LEDs. A first longitudinal lens is positioned with respect to the first linear array of LEDs. The first longitudinal lens receives light emitted by the first linear array of LEDs over a respective first angular range and redirects the light over a respective second angular range. The second support structure comprises a second longitudinal light source. The second longitudinal light source comprises a second linear array of LEDs. A second longitudinal lens is positioned with respect to the second linear array of LEDs. The second longitudinal lens receives light emitted by the second linear array of LEDs over a respective first angular range and redirects the light over a respective second angular range. A reflector extends between the first support structure and the second support structure. The reflector comprises a flexible material having at least one diffusedly reflective surface. The reflector is configurable to an operational configuration with the at least one diffusedly reflective surface positioned to receive the light redirected in the respective second angular ranges from the first and second longitudinal lenses. The reflector is configurable to a transportable configuration with at least a portion of the reflector wrapped around at least one of the first and second support structures.

Another aspect of the invention in accordance with embodiments disclosed herein is a method for providing indirect lighting at a location. The method includes transporting an indirect lighting system to the location. The indirect lighting system includes a first support structure, a second support structure and a flexible reflector. The first support structure has a first light source and a first longitudinal lens. The second support structure has a second light source and a second longitudinal lens. The flexible reflector has at least one diffusedly reflective surface. The flexible reflector is wrapped around at least one of the first and second support structures for transportation. The method further includes unwrapping the flexible reflector from the at least one of the first and second support structures. The method further includes spacing the first support structure apart from the second support structure with the flexible reflector extending between the first support structure and the second support structure.

DETAILED DESCRIPTION OF THE INVENTION

Figure 1:
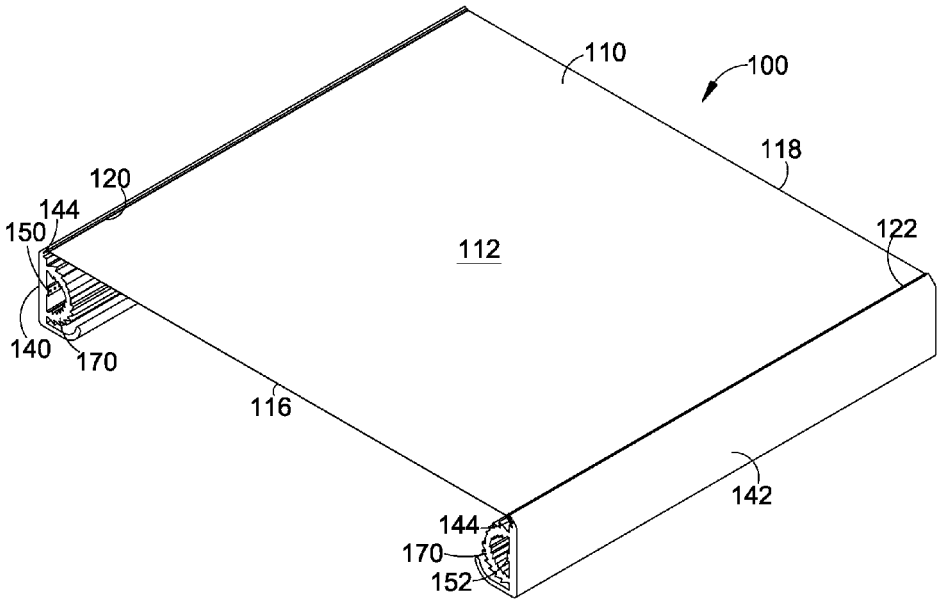
FIG. 1 illustrates a top perspective view of an indirect lighting system in accordance with aspects of the present invention showing the indirect lighting system in an operational configuration, the lighting system including a flexible reflector spanning between first and second support structures.
Figure 2:
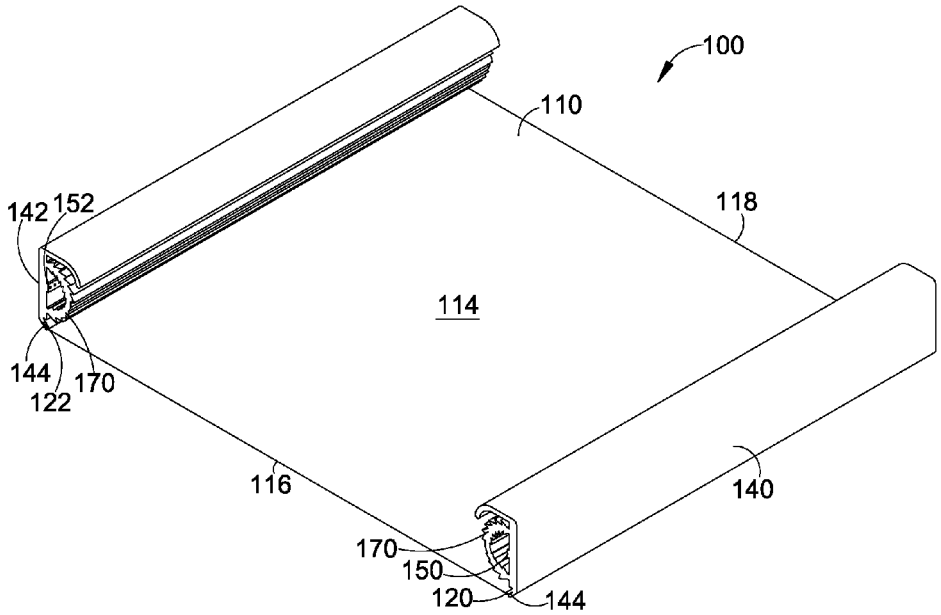
FIG. 2 illustrates a bottom perspective view of the indirect lighting system of FIG. 1.
Figure 3:
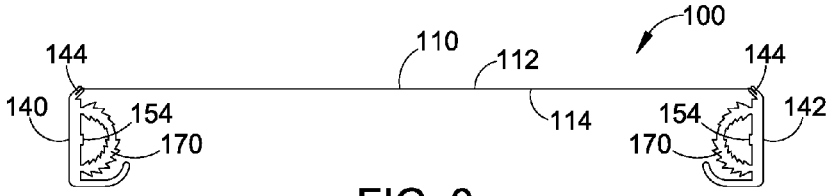
FIG. 3 illustrates an end elevational view of the indirect lighting system of FIG. 1.

In the following description, various dimensional and orientation words, such as height, width, length, longitudinal, horizontal, vertical, up, down, left, right, tall, low profile, and the like, may be used with respect to the illustrated drawings. Such words are used for ease of description with respect to the particular drawings and are not intended to limit the described embodiments to the orientations shown. It should be understood that the illustrated embodiments can be oriented at various angles and that the dimensional and orientation words should be considered relative to an implied base plane that would rotate with the embodiment to a revised selected orientation.

As illustrated in FIGS. 1-5, a lighting system 100 in accordance with aspects of the present invention includes a flexible reflector 110. The reflector 110 has an outer surface 112 and an inner surface 114. The reflector extends longitudinally by a reflector length from a first end 116 to a second end 118. The reflector extends laterally from a first longitudinal edge 120 to a second longitudinal edge 122. The reflector has a reflector width between the two longitudinal edges. The length and width may be selected in accordance with a desired operational configuration.

The inner surface 114 of the flexible reflector 110 is diffusedly reflective. For example, in one embodiment, the inner surface of the reflector comprises a white diffuse reflective film such as, for example, White97™ Film or White98™ Film, which are commercially available from WhiteOptics®, LLC, of New Castle, Del. The two materials are highly diffuse. The reflective films are thin (e.g., 0.016 inch thick for the White97™ Film and 0.008 inch thick for the White98™ Film). Other diffuse reflective materials from other sources may also be used. The reflective film may form the entire reflector in some applications. In other applications, the thin reflective film is attached to a stronger backing surface. For example, the reflective film may be attached to a polyester film (e.g., Mylar® film), to a plastic sheet, or to another stronger material to provide protection for the thin reflective sheet. The reflective films from WhiteOptics LLC, for example, are available with an adhesive that allows the film to be easily attached to the inner surface of the backing material The first longitudinal edge 120 of the reflector 110 is secured to a first support structure 140. The second longitudinal edge 122 is secured to a second support structure 142. In the illustrated embodiment, each support structure includes a respective edge receiving slot 144 that receives and secures portions of reflector proximate to the respective longitudinal edges. The portions of the reflector proximate to the two longitudinal edges may be permanently secured within the receiving slot (e.g., by gluing or other adhesion techniques). Alternatively, the portions of the reflector proximate to the two longitudinal edges may be removably secured within the receiving slots to enable replacement of the reflector when worn or when a narrower or wider reflector is desired for a particular use. Each receiving slot may be selectively widened and closed by a clamping mechanism (not shown) to allow insertion and securing of the respective longitudinal edge. In alternative embodiments, the support structures may not include the receiving slots. In such embodiments, the portions of the reflector proximate to the longitudinal edges may be secured directly to a respective outer surface of each support structure. In any such embodiment, the portions of the reflector proximate to the longitudinal edges may be reinforced for additional structural integrity.

As shown in FIGS. 1-5, when the lighting system 100 is configured to provide light at a job site or the like, the first support structure 140 and the second support structure 142 are positioned facing each other. The two support structures are spaced apart by a sufficient distance such that the reflector 110 spans the distance between the two support structures. Although the reflector is shown as substantially straight between the two support structures to indicate that the reflector is taut, the reflector may be allowed to sag between the two support structures without significantly reducing the effectiveness of the reflector to diffuse the light incident on the reflector.

The first support structure 140 supports a first light source 150. The second support structure 142 supports a second light source 152. Each light source comprises a plurality of light sources (e.g., light-emitting diodes (LEDs)) 154 that are spaced apart in a linear array. The array is longitudinally parallel to the respective longitudinal edges 120, 122 of the reflector 110. For example, for a reflector 110 having a longitudinal length of approximately 48 inches, 96 LEDs may be spaced apart by approximately 0.5 inch (center-to-center) along the length of each respective light source. In one embodiment, the LEDs are connected in a series-parallel configuration (e.g., 12 parallel branches of 8 LEDs connected in series within each branch). The LEDs are powered by a power source (not shown) in a conventional manner. For example, in one embodiment, the LEDs may be powered by a Model No. D10CC30UNVTW 1,050-milliampere LED driver, which is commercially available from Universal Lighting Technologies in Nashville, Tenn. The driver provides up to 1,050 milliamperes of current at an output voltage up to 30 volts.

Figure 4:
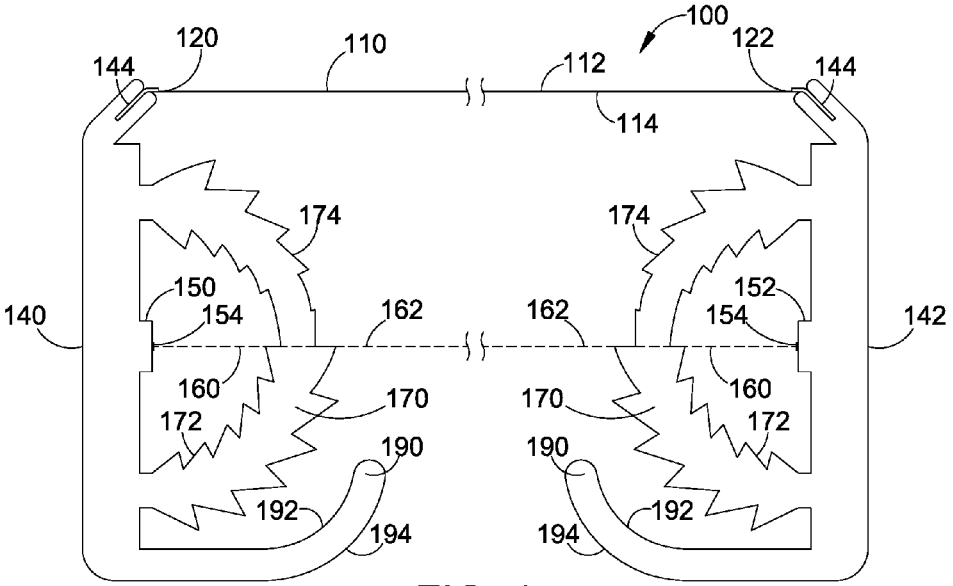
FIG. 4 illustrates an enlarged elevational view of the indirect lighting system with the reflector shown partially broken.
Figure 5:
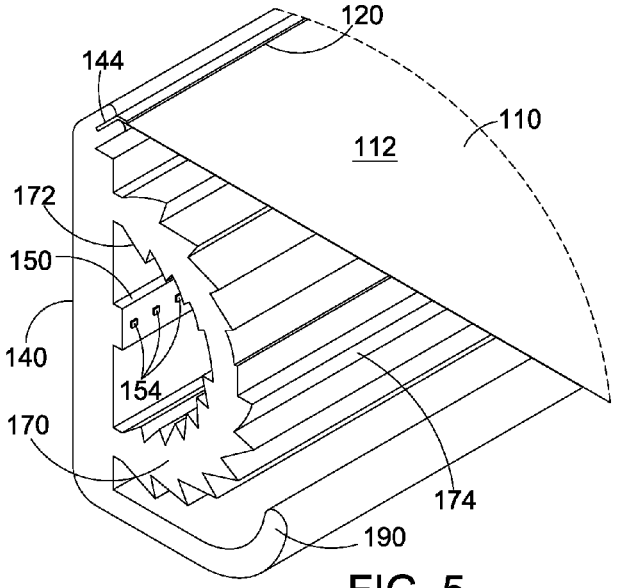
FIG. 5 illustrates an enlarged top perspective view of a front left portion of the indirect lighting system of FIG. 1 within the area - -5- - in FIG. 1, the view showing the first support structure in more detail.

As shown in the enlarged end view in FIG. 4, each LED 154 in the support structures 140, 142 emits light with respect to a respective emission axis 160. The LEDs are substantially aligned longitudinally such that a longitudinal array of the emission axes of the LEDs form an emission plane 162. Since the emission axes and the emission plane are coincident, the axes and plane are represented in the end view with a single centerline.

Each LED 154 emits light over an angular range from below the respective emission axis 160 to above the respective emission axis. Thus, the LEDs in the longitudinal array emit light over a corresponding angular range with respect to the emission plane 162. For example, in one embodiment, the LEDs emit light over an angular emission range of ±85 degrees with respect to the emission plane.

As further shown in the enlarged end view in FIG. 4 of the support structures 140, 142, each support structure includes a longitudinal optical structure (e.g., lens) 170 positioned to receive and redirect the light emitted by the longitudinal array of LEDs 154. The optical structure is configured as an asymmetrical lens. An inner surface 172 of the asymmetrical lens receives substantially all of the light from the LEDs over the complete angular emission range. The optical structure includes a plurality of Fresnel-like surfaces on the inner surface and on an outer surface 174 to cause light incident on the inner surface to be refracted at certain locations and to be totally internally reflected at other locations.

Figure 6:
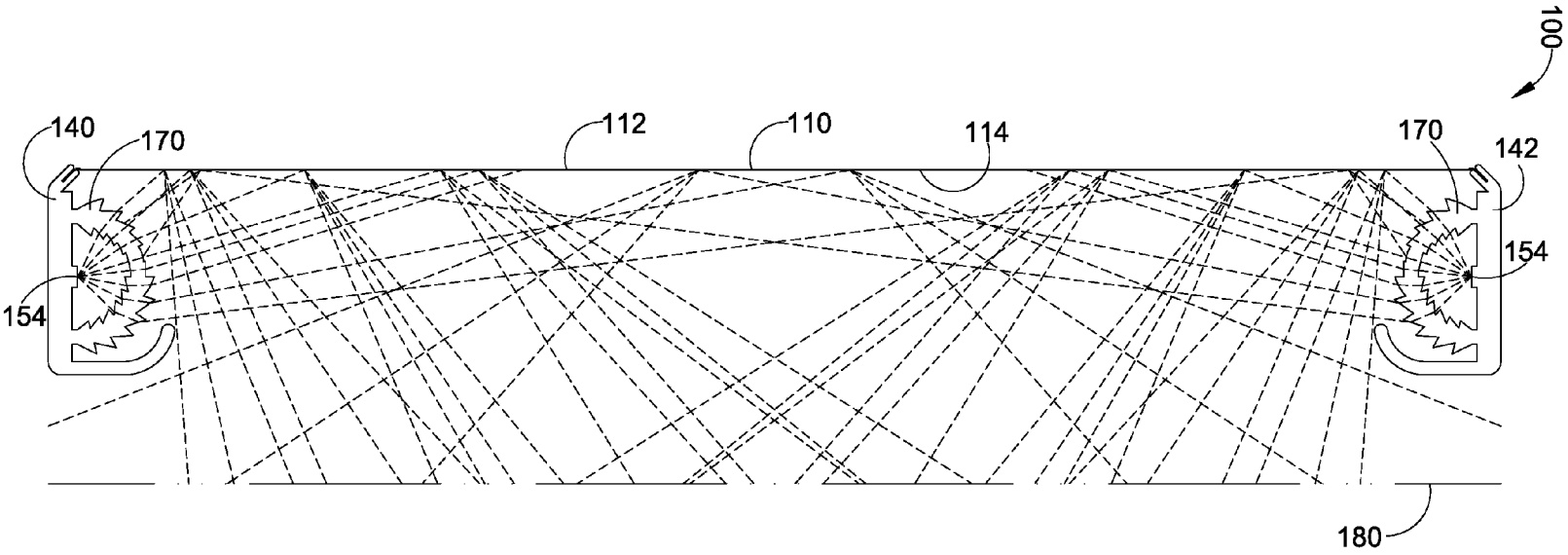
FIG. 6 illustrates a schematic representation of the end view of FIG. 2 with a plurality of light rays superimposed on the view to show the indirect lighting provided by the system.

As illustrated in FIG. 6, the light emitted by the LEDs 154 and received at the inner surfaces 172 of the optical structures 170 is redirected by refractive surfaces and the total internal reflection (TIR) surfaces of the asymmetrical lens to cause the light to exit from the outer surface 174 over an exit angular range with respect to the emission plane. Preferably, the optical structure is configured such that the light exiting from the outer surfaces of the lenses is directed toward the inner surface 114 of the reflector 110. The light incident on the inner surface of the reflector is diffusedly reflected. A substantial portion of the diffusedly reflected light is directed toward an illumination plane 180 below the two support structures 140, 142.

Each support structure 140, 142 may further include a protruding structure 190 below the optical structure (lens) 170. The protruding structure may have an inner reflective surface 192 positioned to receive any stray light emitted from the outer surface 174 of the lens below the emission plane 162 and to reflect the stray light toward the inner surface 114 of the reflector 110. An outer surface 194 of the protruding structure may be curved to provide a surface around which the reflector may be wound as described below.

Figure 7:
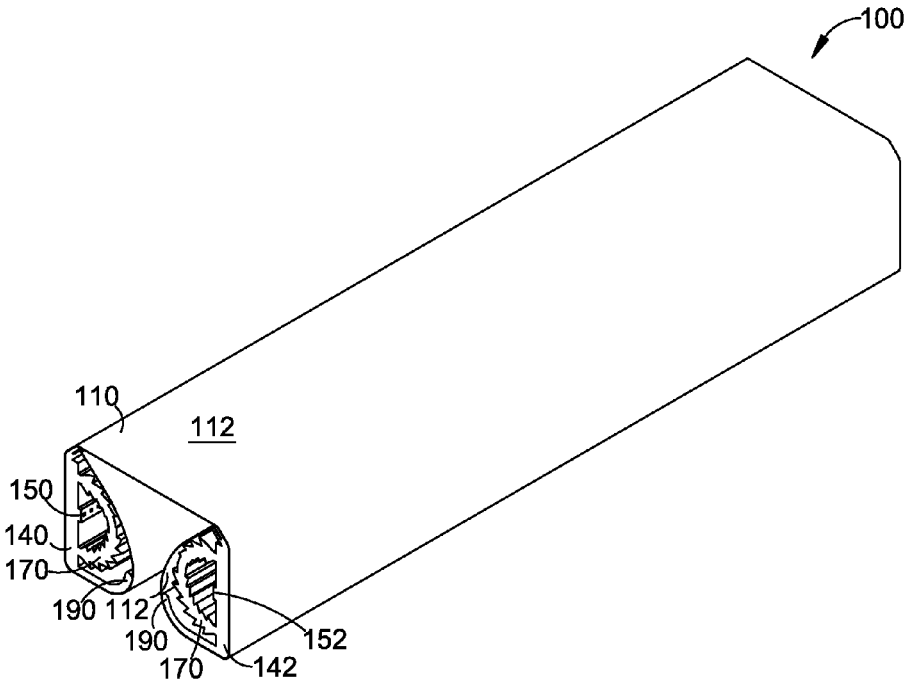
FIG. 7 illustrates a top perspective view of the indirect lighting system of FIG. 1 showing the indirect lighting system in a reduced form factor configuration for transportation.
Figure 8:
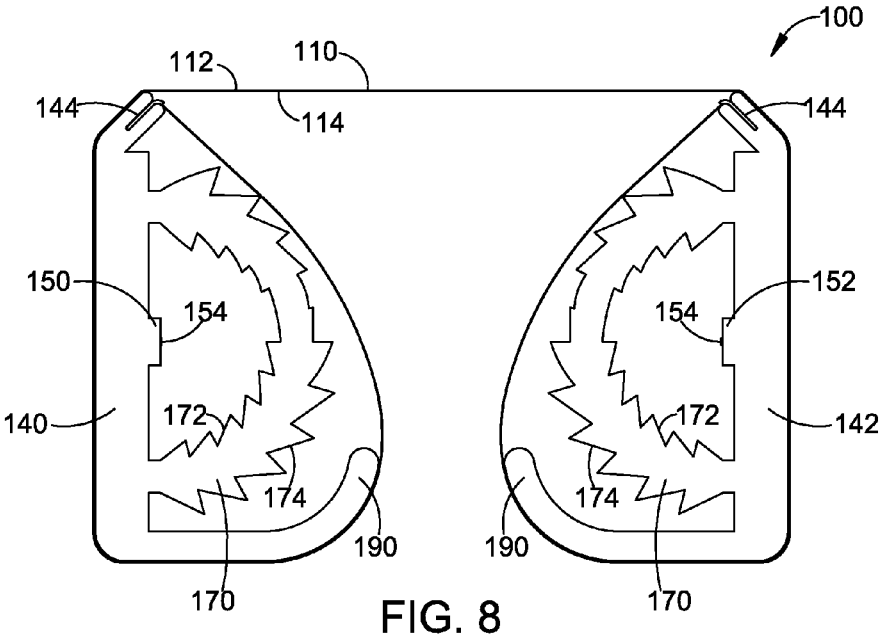
FIG. 8 illustrates an end elevational view of the indirect lighting system in the reduced form factor configuration of FIG. 7.

As illustrated in FIGS. 7 and 8, the lighting system is transported to a job site or returned from a job site by winding the flexible reflector 110 around each of the support structures 140, 142 to form a scroll-like configuration with approximately one-half of the reflector wound around the first support structure and approximately one-half of the reflector wound around the second support structure. Alternatively, the reflector may be wound unevenly such that more of the reflector is wound around one of the two support structures.

Although there have been described particular embodiments of the present invention of a new and useful "Offset Indirect High Efficiency Lighting System," it is not intended that such references be construed as limitations upon the scope of this invention except as set forth in the following claims.

What is claimed is:

1. A portable indirect lighting apparatus comprising:

a first support structure comprising a first longitudinal light source, the first longitudinal light source comprising a first linear array of light-emitting diodes (LEDs), and a first longitudinal lens positioned with respect to the first linear array of LEDs, the first longitudinal lens receiving light emitted by the first linear array of LEDs over a respective first angular range and redirecting the light over a respective second angular range;

a second support structure comprising a second longitudinal light source, the second longitudinal light source comprising a second linear array of LEDs, and a second longitudinal lens positioned with respect to the second linear array of LEDs, the second longitudinal lens receiving light emitted by the second linear array of LEDs over a respective first angular range and redirecting the light over a respective second angular range;

and a reflector extending between the first support structure and the second support structure, the reflector comprising a flexible material having at least one diffusedly reflective surface, the reflector having a transportable configuration with at least a portion of the reflector wrapped around at least one of the first and second support structures and an operational configuration with the reflector unwrapped from the at least one of the first and second support structures, the at least one diffusedly reflective surface receiving the light redirected in the respective second angular ranges from the first and second longitudinal lenses in the operational configuration.

2. A method for providing indirect lighting at a location comprising:

transporting an indirect lighting system to the location, the indirect lighting system comprising a first support structure having a first light source and a first longitudinal lens, a second support structure having a second light source and a second longitudinal lens, and a flexible reflector having at least one diffusedly reflective surface, the flexible reflector wrapped around at least one of the first and second support structures;

unwrapping the flexible reflector from the at least one of the first and second support structures; and spacing the first support structure apart from the second support structure with the flexible reflector extending between the first support structure and the second support structure.

* * * * *